US007413027B2

(12) United States Patent
Glaser et al.

(10) Patent No.: US 7,413,027 B2
(45) Date of Patent: Aug. 19, 2008

(54) IMPACT POWER TOOL WITH A PRECISION CONTROLLED DRIVE SYSTEM

(75) Inventors: Donald J. Glaser, Emporia, KS (US); Lon C. Tidwell, Emporia, KS (US)

(73) Assignee: Glendo Corporation, Emporia, KS (US)

( * ) Notice: Subject to any disclaimer, the term of this patent is extended or adjusted under 35 U.S.C. 154(b) by 0 days.

(21) Appl. No.: 11/462,334

(22) Filed: Aug. 3, 2006

(65) Prior Publication Data

US 2007/0034395 A1 Feb. 15, 2007

Related U.S. Application Data

(60) Provisional application No. 60/595,764, filed on Aug. 3, 2005.

(51) Int. Cl.
*B25D 9/14* (2006.01)

(52) U.S. Cl. ..... 173/115; 173/30; 173/200; 173/207

(58) Field of Classification Search ..... 173/30, 173/115, 121, 210, 128, 132, 122, 206, 207; 60/371, 376, 387, 593; 137/487.5, 102
See application file for complete search history.

(56) References Cited

U.S. PATENT DOCUMENTS 3,393,755 A * 7/1968 Glaser et al. ..... 173/200
4,694,912 A 9/1987 Glaser
4,903,784 A * 2/1990 Glaser ..... 173/200
5,203,417 A * 4/1993 Glaser ..... 173/200
5,857,485 A * 1/1999 Perkins et al. ..... 137/487.5
6,488,102 B2 * 12/2002 Lindsay ..... 173/115
6,691,798 B1 * 2/2004 Lindsay ..... 173/115
7,048,073 B2 * 5/2006 Hezeltine ..... 173/1

* cited by examiner

*Primary Examiner*—Scott A. Smith
(74) *Attorney, Agent, or Firm*—Hovey Williams LLP

(57) ABSTRACT

An improved impact power tool for carving and engraving an article comprises an air delivery system operable to communicate with a pressurized air source; a drive assembly operable to receive air from the pressurized air source via the air delivery system; a hand held device in driven communication with the drive assembly; and a housing for storage of the air delivery system and drive assembly. The tool includes an improved valve design, a throttle bias valve, and an air storage tank housed within the housing, and an improved housing construction. The improved valve design and air storage tank enable greater stroke speeds of a work tool over a wider power range while also improving the crispness and speed of the impact reaction time over the entire range. The throttle bias valve is in communication with an additional exhaust path, such that the bias valve allows improved control of the hand held device and improved operation over a wider range of air pressures.

10 Claims, 10 Drawing Sheets

IMPACT POWER TOOL WITH A PRECISION CONTROLLED DRIVE SYSTEM

RELATED APPLICATION

This application claims the benefit of U.S. Provisional Application No. 60/595,764, filed Aug. 3, 2005, and entitled IMPACT POWER TOOL WITH PRECISION CONTROLLED DRIVE SYSTEM, which is hereby incorporated by reference herein.

BACKGROUND OF THE INVENTION

1. Field of the Invention

The present invention relates generally to impact power tools. More specifically, the present invention concerns an impact power tool, such as a pneumatically powered, rotary valve controlled tool, for use in delicate hand working operations, such as detailed, precise, and fine engraving, carving, and stone setting work.

2. Discussion of Prior Art

Delicate hand working operations, such as detailed, precise, and fine engraving, carving, and cutting on metals, woods, stones, and the like, as well as stone setting work require an impact tool that delivers a low impact energy level for each stroke of the tool and that is capable of delivering such low impact strokes at a rapid rate. These problems have previously been identified in U.S. Pat. No. 4,694,912, assigned of record to the assignee of the present invention, issued Sep. 22, 1987 and entitled CONTROLLED IMPACT POWER TOOL ("Glaser '912 patent") and hereby incorporated by reference herein.

The impact power tool disclosed in the Glaser '912 patent was an advance in the field and solved many of the problems identified in the art at the time. However, it has been determined that engravers and jewelry craftsmen increasingly are desiring to utilize larger hand piece attachments in their impact power tools, such as those capable of advanced carving applications on virtually any type of material, as well as desiring to utilize a wider range of hand pieces on the same impact power tool system for various and wide ranging applications. These desires are not being adequately met with the prior art impact power tools. In fact, craftsman desiring to perform multiple crafting applications that each require a different, wide range of power output must currently utilize multiple impact power tool systems to accomplish their tasks and even then, the combination of systems does not adequately address their desired ranges of power. Current impact power tool systems, particularly the use of multiple systems, undesirably consume valuable and limited inventory space on a craftsman's work bench.

Prior art impact power tools are also subject to other problems and limitations. For example, craftsman desire a crisp, quick, and immediate impact control adjustment. Such response time is simply lacking in prior art impact power tools. This problem is further frustrated by the craftsman's frequent "over-driving" of the tool—for example, when the craftsman is searching for the desired stroke speed or impact energy that is outside of the limits of the prior art tools. Accordingly, there is a need for an improved impact power tool.

SUMMARY OF THE INVENTION

The present invention provides an improved impact power tool that does not suffer from the problems and limitations of the prior art impact power tools detailed above. The impact power tool of the present invention provides several advancements, each having advantages over the prior art tools, including an improved housing design and an improved precision controlled drive system that enables greater stroke speeds of a work tool over a wider power range while also improving the crispness and speed of the impact reaction time over the entire range.

A first aspect of the present invention concerns a drive assembly comprising a rotary pulse valve. A central rotor of the valve has an elongated slot that communicates with an elongated slot of a bushing of the valve. When the elongated slots are aligned during rotation of the valve, a faster and more powerful stroke of the work tool is obtained.

A second aspect of the present invention concerns an air storage tank housed within a housing of the impact power tool and operable to store approximately fifty times greater pressurized, regulated air than prior art impact power tools. Quick retrieval of regulated air from the storage tank allows for a constant supply of air to the work tool, improving both low speed impact and high speed response.

A third aspect of the present invention concerns an improved housing of the impact power tool. The housing comprises a plastic, dielectric base plate on which electrical terminals can be connected. Additionally, a cover of the housing comprises a plurality of flat, metal plates and a plurality of beveled rails having channels formed therein. The plates are secured to the beveled rails through use of hex nuts and washers for ease of manufacturing and replacement should threads become stripped.

An embodiment of the impact power tool comprises an air delivery system operable to communicate with a pressurized air source; a drive assembly operable to receive air from the pressurized air source via the air delivery system; a hand held device in driven communication with the drive assembly; and a housing for storage of the air delivery system and drive assembly.

Other aspects and advantages of the present invention will be apparent from the following detailed description of the preferred embodiments and the accompanying drawing figures.

BRIEF DESCRIPTION OF THE DRAWING FIGURES

Embodiments of the invention are described in detail below with reference to the attached drawing figures, wherein.

Figure 14:
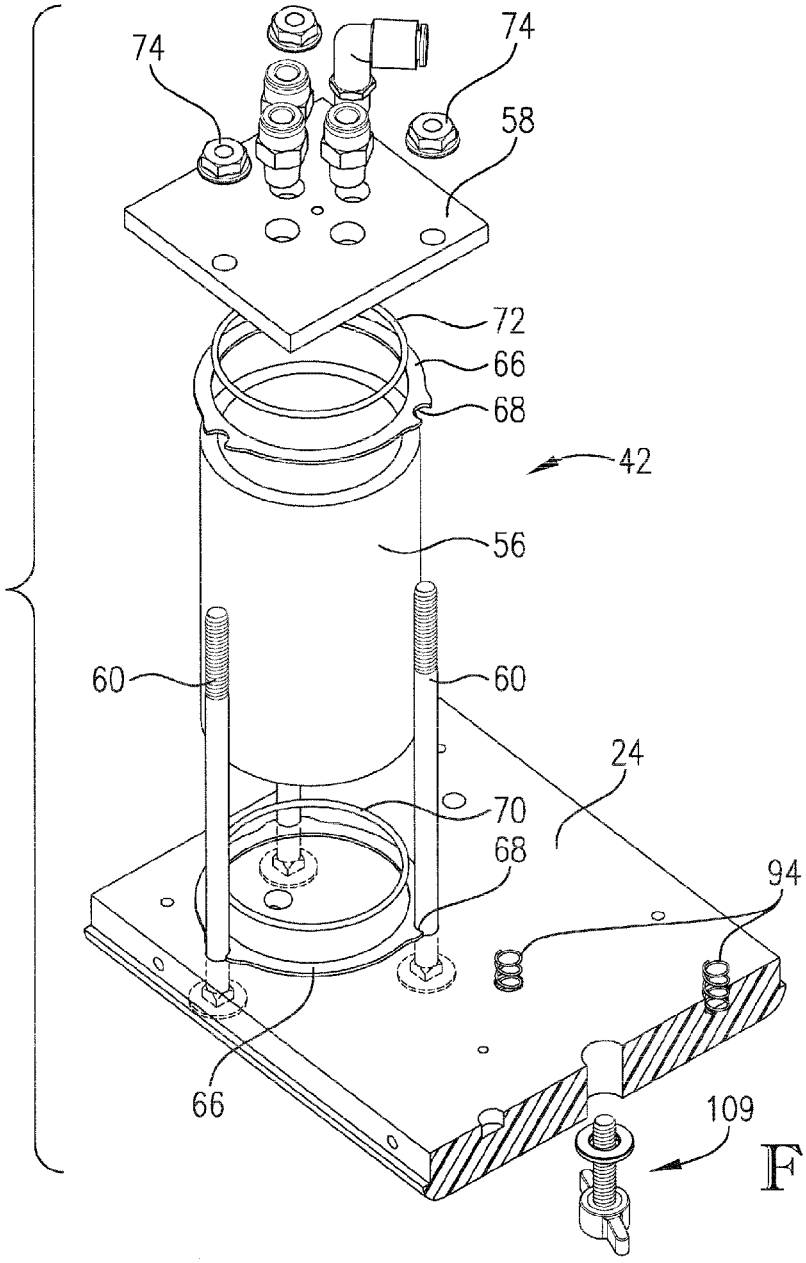
Figure 15:
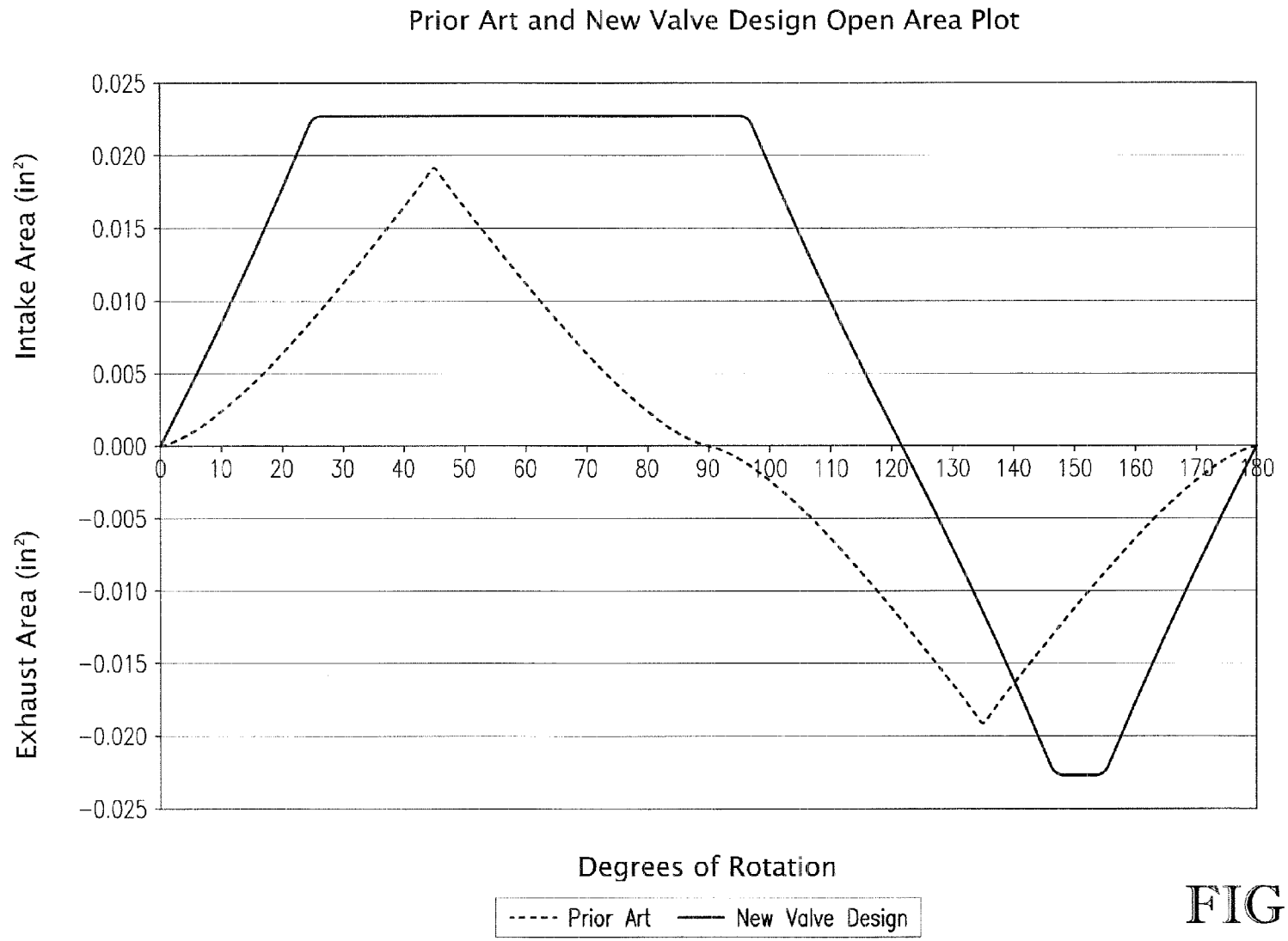

FIG. 14 is an enlarged partial sectional assembly view of the impact power tool illustrated in FIGS. 1-13 showing the assembly of the air storage tank; and FIG. 15 is a graph illustrating the degrees of rotation of the a central rotor versus an area of alignment of an elongated slot of the central rotor and an elongated slot of the valve bushing and particularly illustrating the coverage area of the prior art in broken line and the coverage area of the present invention in solid line.

The drawing figures do not limit the present invention to the specific embodiments disclosed and described herein. The drawings are not necessarily to scale, emphasis instead being placed upon clearly illustrating the principles of the preferred embodiment.

DETAILED DESCRIPTION OF THE EMBODIMENTS

The preferred forms of the invention described above are to be used as illustration only and should not be utilized in a limiting sense in interpreting the scope of the present invention. Obvious modifications to the exemplary embodiments, as hereinabove set forth, could be readily made by those skilled in the art without departing from the spirit of the present invention.

The present invention is an impact power tool 10 for use in delicate hand working operations, such as detailed, precise, and fine engraving, carving, and stone setting work. An embodiment of the impact power tool comprises an air delivery system 12 operable to communicate with a pressurized air source (not shown); a drive assembly 16 operable to receive air from the pressurized air source via the air delivery system 12; a hand held device 18 in driven communication with the drive assembly 16 and for performing the delicate hand working operations; and a housing 20 for storage of the air delivery system 12 and drive assembly 16 and defining an interior space 22 and comprising a base plate 24 and cover 26, wherein the cover 26 comprises left and right side panels 28,30, a back panel 32, a front panel 34, and a top panel 36 (see FIG. 4), all of which are discussed in more detail below.

The air delivery system 12 comprises an air filter 38, an air pressure regulator 40, and an air storage tank 42 in communication with the air regulator 40. The air delivery system 12 is in communication with the pressurized air source (not shown), such as an air compressor operable to provide approximately 45-120 psi of air pressure. As known in the art, a motive fluid may also be used instead of the pressurized air source.

Figure 1:
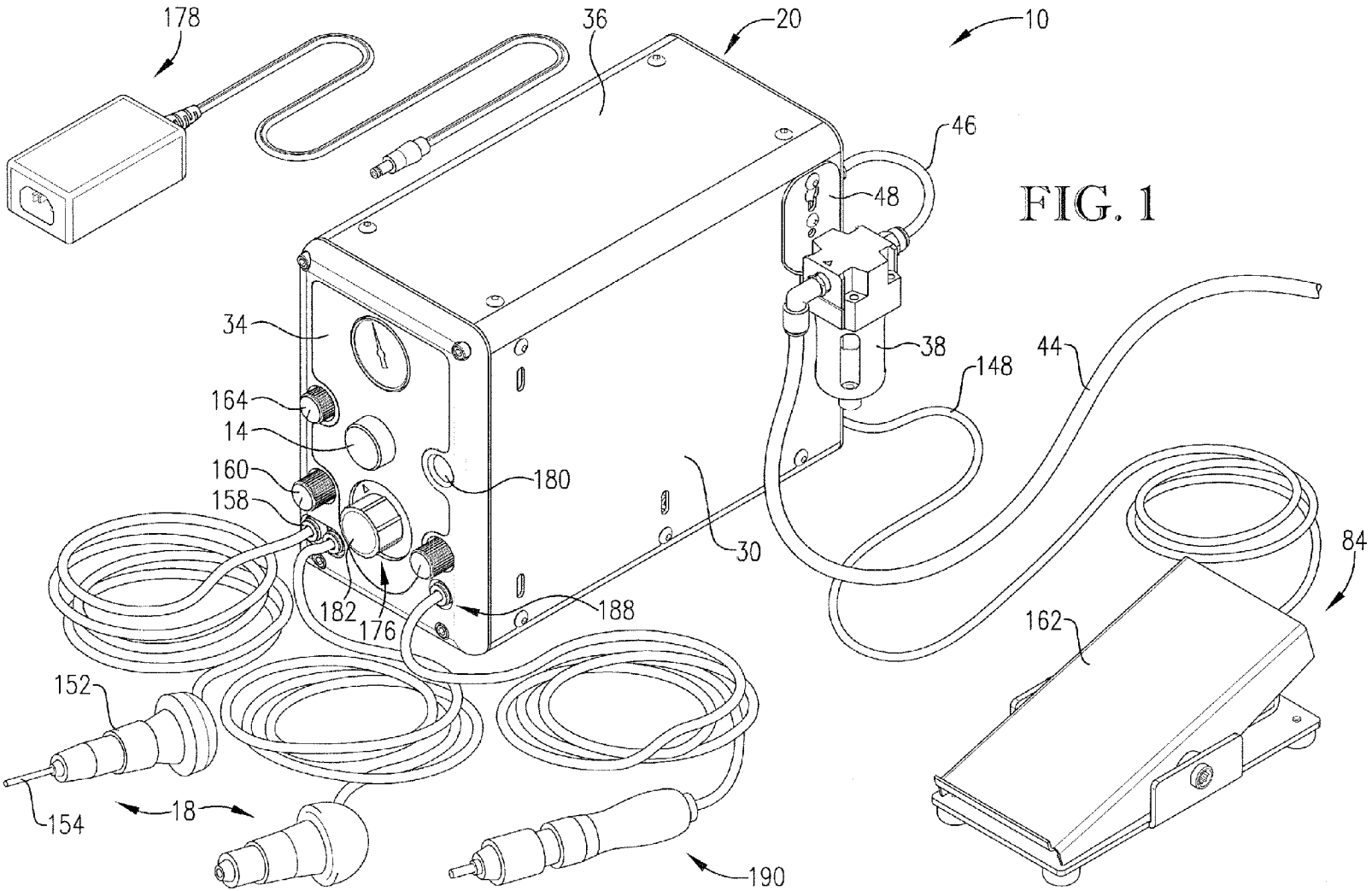
FIG. 1 is a front perspective view of an impact power tool constructed in accordance with the principles of a preferred embodiment of the present invention.

The air filter 38 is any air filter well known in the art and operable to filter air incoming from the pressurized air source. A suitable air filter is sold by SMC Corporation of America of Indianapolis, Ind. under product code AF20-N01-CZ. The air from the pressurized air source is transmitted to the air filter 38 via a source supply line 44, as illustrated in FIG. 1. Air exiting the filter 38 is supplied to the air pressure regulator 40 via a filter supply line 46, which is guided through the back panel 32 of the housing 20 and to the air pressure regulator 40. The filter supply line 46 and any other lines discussed herein are a plastic hose operable to withstand transmittal of pressurized air therethrough.

Figure 3:
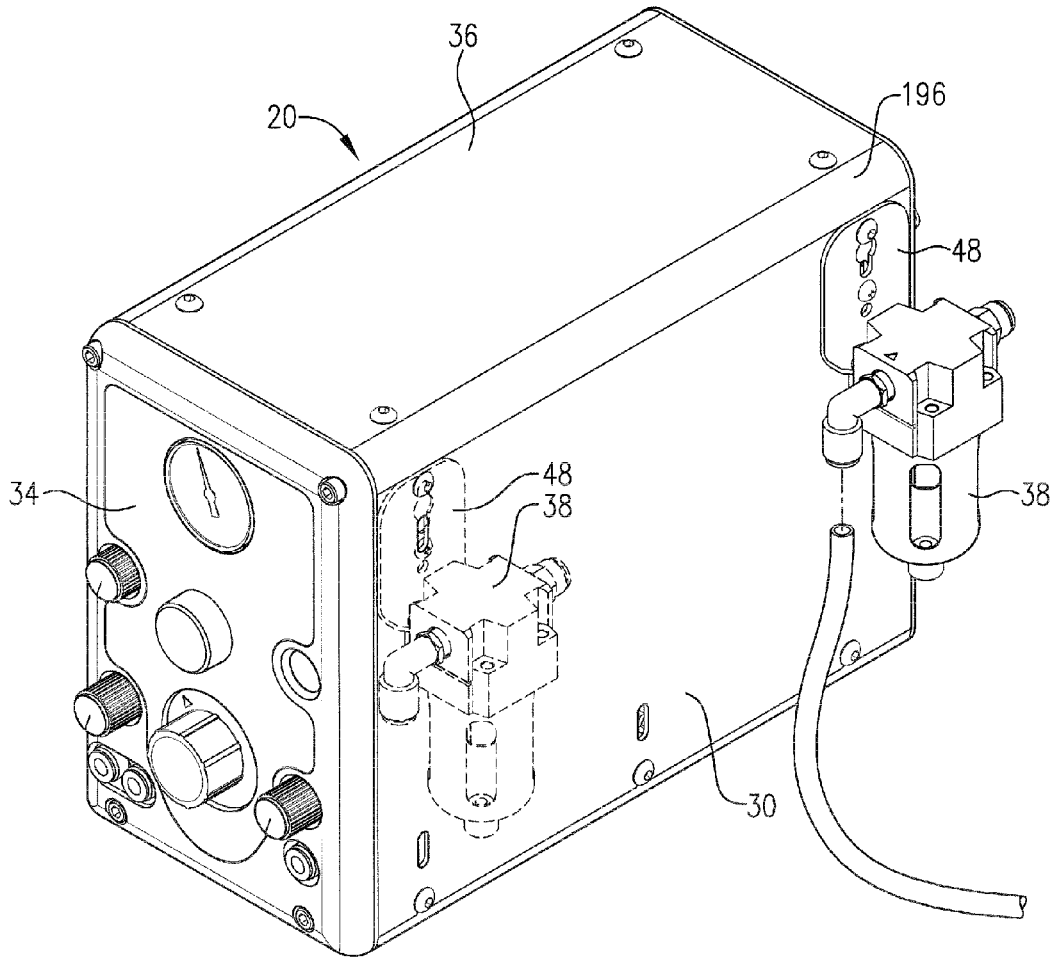
FIG. 3 is a front perspective view of the impact power tool illustrated in FIGS. 1-2 with components removed and showing various adjustable locations (some shown in phantom) for the air regulator on one side of the cover of the housing.

The air filter 38 is conveniently removably mounted on the right side panel 30 of the housing 20 (see FIG. 1) and can be moved to various locations on the housing 20 by selective mounting of a keyhole bracket 48, as illustrated in FIG. 3 in phantom. Selective mounting of the air filter 38 on the housing 20 allows for positioning of the impact power tool 10 at preferred locations at a user's crowded work bench.

Once air exits the air filter 38 and is guided through the filter supply line 46, the pressurized air enters the air pressure regulator 40, which regulates the air to a desired pressure. Unregulated pressurized air is usually approximately 35-100 psi and must be scaled down to a smaller pressure for operation with the impact power tool 10. The desired pressure to be achieved by the air pressure regulator 40 will be dependent on the hand held device 18 and the pressure desired for operating it; however, typical operating air pressures range from 8-25 psi. The air pressure may be selectively regulated via an air regulator dial 14 mounted on the front panel 34 of the housing 20. Although the air pressure regulator 40 is operable to regulate the pressure as discussed above, any suitable air pressure regulator may be used, such as the air pressure regulator provided by SMC Corporation of America under product code IR1010-N01, and smaller or larger ranges of air pressure are contemplated by the present invention.

Figure 6:
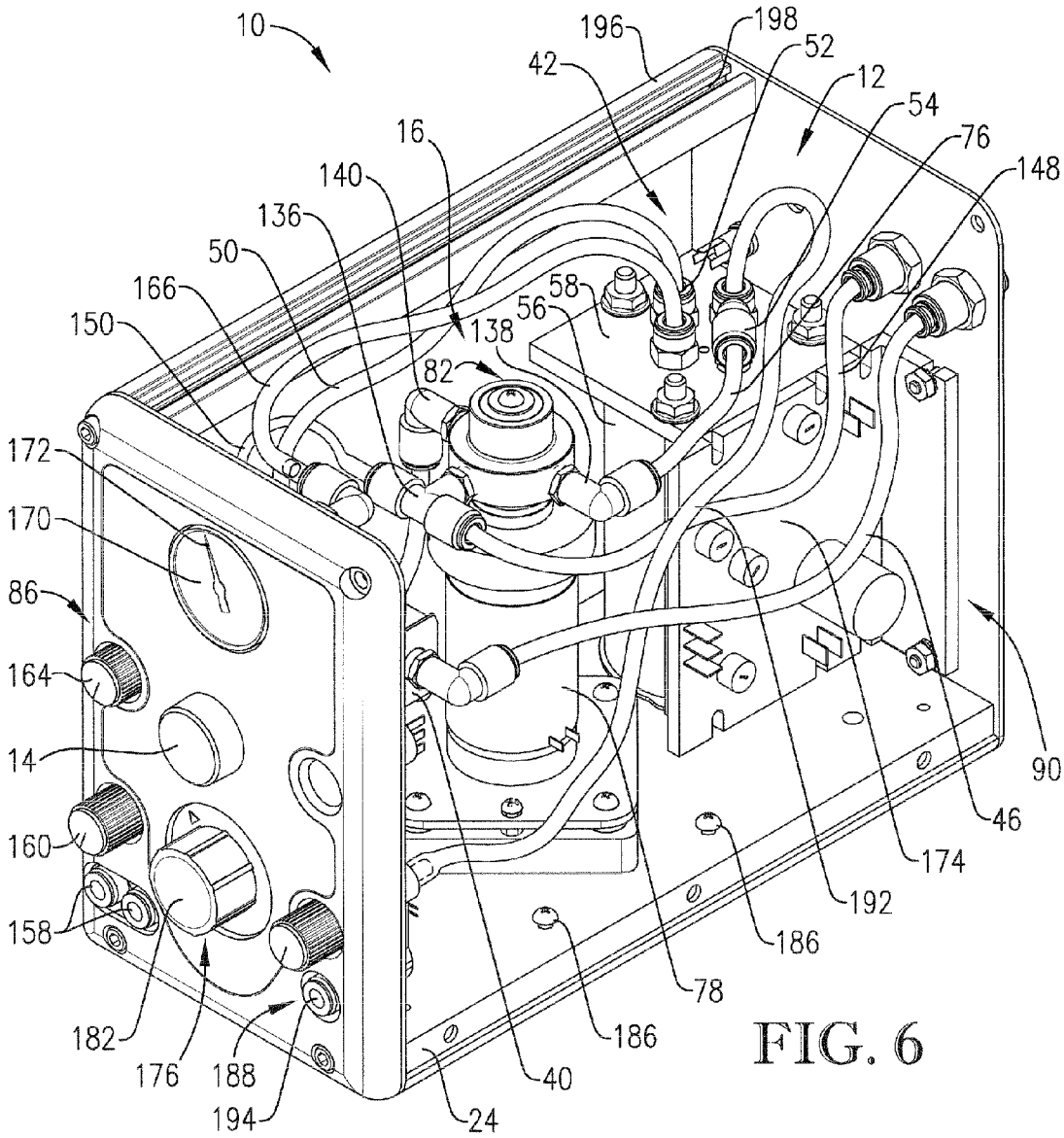
FIG. 6 is a front perspective view of the impact power tool similar to FIGS. 3 and 4 with two of the cover panels removed to show some of the internal components of the drive assembly within the housing.

Air exiting the air pressure regulator 40 is moved through a regulator supply line 50 to the air storage tank 42 via a tank inlet 52, as best illustrated in FIG. 6. The air storage tank 42 comprises the tank inlet 52, a tank outlet 54, an internal air chamber 56, and an air manifold 58. As best illustrated in FIG. 14, the air storage tank 42 is mounted to the base plate 24 via a plurality of elongated carriage bolts 60 mounted to the base plate 24 and extending upwards through the air manifold 58. The air manifold 58 is positioned atop an upper end of the storage tank 42 and serves as a cover for the tank 42. Similarly, the base plate 24 serves as a bottom for the tank 42. The carriage bolts 60 are in securing contact with lower end and upper end multi-prong brackets 66. As illustrated in FIG. 14, each bracket 66 includes a prong 68 in which the respective bolt 60 is forcibly mated. A lower end O-ring 70 is positioned between the lower end bracket 66 and a lower end of the air storage tank 42, and an upper end O-ring 72 is positioned between the upper end bracket 66 and the air manifold 58. The carriage bolts 60 are threaded through and securely coupled with the air manifold 58 via a plurality of upper end nuts 74. When the air storage tank 42 is secured with the bolts 60 and multi-prong brackets 66 as described above, the tank 42 is prevented from movement during operation or transport.

Figure 7:
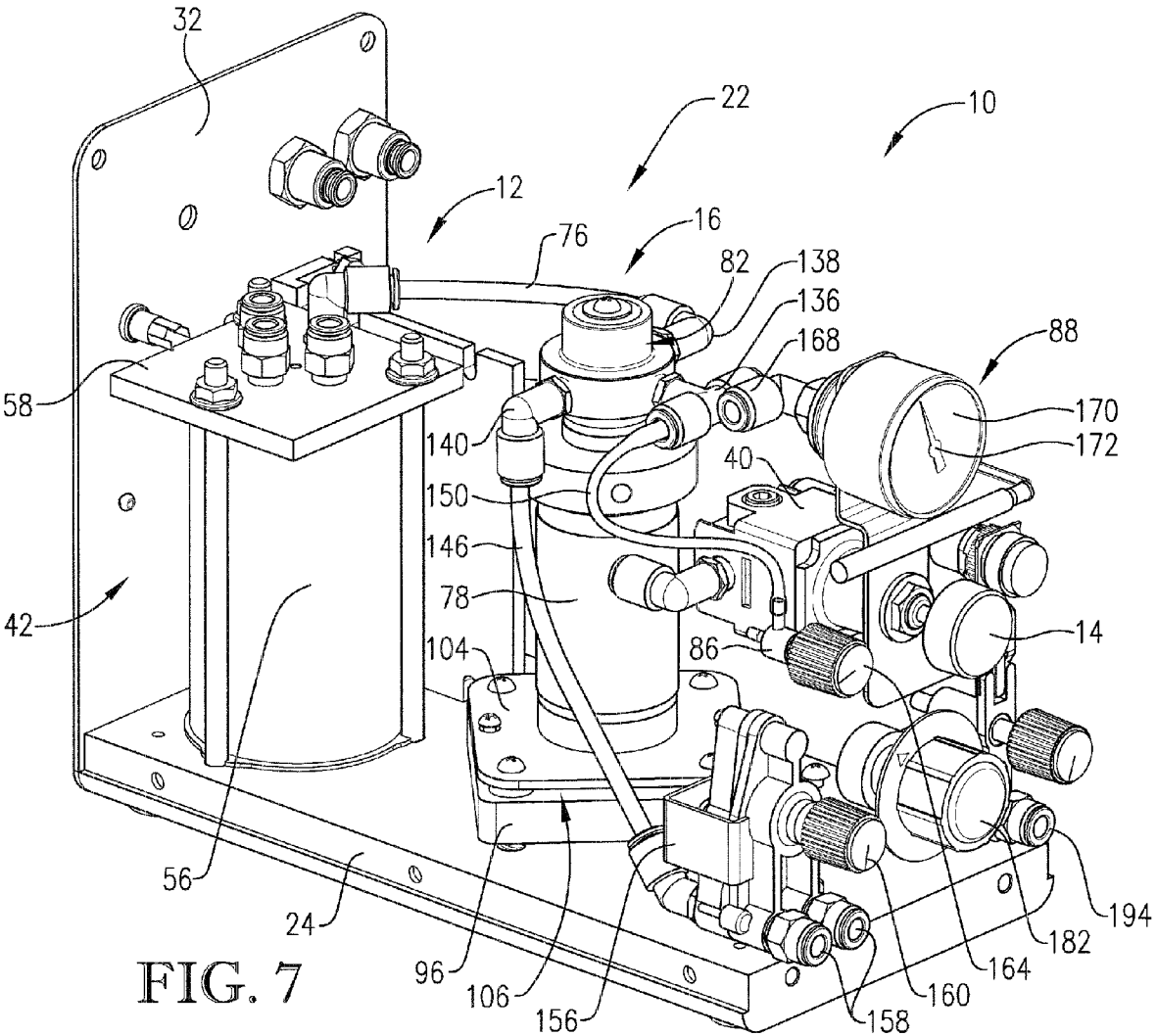
FIG. 7 is a front perspective view of the impact power tool illustrated in FIGS. 1-6 with the three cover panels and one end plate removed to show some of the components of the drive assembly.

The air storage tank 42 serves as a storage tank for pressurized, regulated air to allow for faster withdrawal of the air. As pressurized, regulated air is required for operation of the hand held device 18, air is transmitted from the tank outlet 54 and through a tank supply line 76, as best illustrated in FIGS. 6 and 7. The air transmitted from the tank supply line 76 travels to the drive assembly 16. The air storage tank 42 allows for a consistent supply of pressure to the hand held device 18, which is discussed more fully below.

Figure 8:
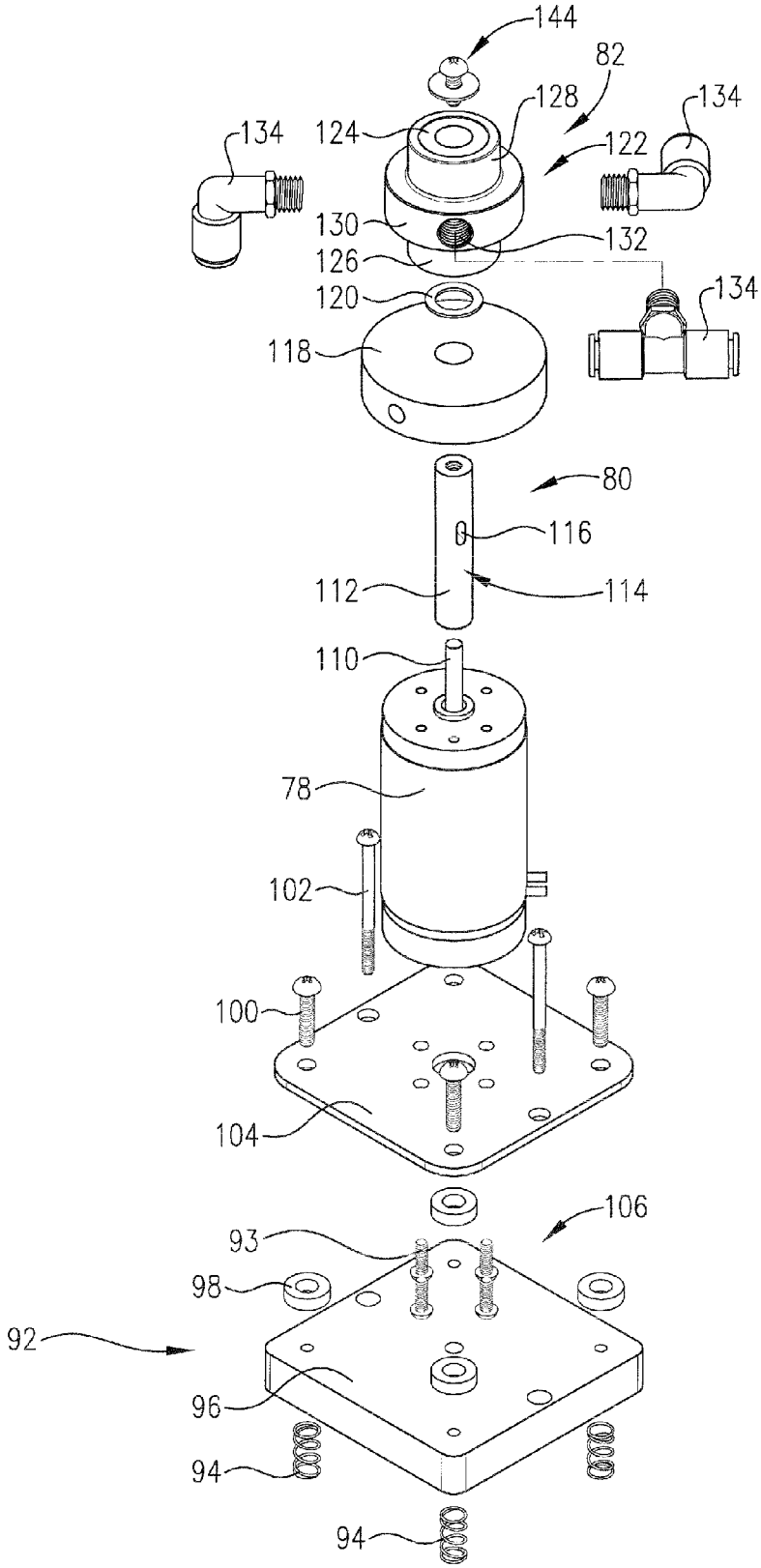
FIG. 8 is a partial, front elevational assembly view of the impact power tool illustrated in FIGS. 1-7 showing the assembly of the rotary valve onto the variable speed motor and the assembly of the motor onto the mounting suspension.

As best illustrated in FIGS. 1 and 8, the drive assembly 16 comprises a variable speed motor 78, a central rotor 80, a rotary valve 82, a throttle 84, a throttle bias valve 86, a pressure gauge 88, and an electrical assembly 90. The variable speed motor 78 is any low voltage motor that allows for operation of the hand held device 18 at the above-described psi and at the below-described pulse and bleed speeds. The motor 78 preferably operates at 24V DC, although other voltage amounts could be used, and the motor is preferably operable to rotate at least four thousand revolutions per minute. A suitable motor is sold by the Hansen Corporation of Princeton, Ind. under product code X16-12924-10.

The motor 78 is preferably mounted on the base plate 24 via a motor suspension system 92, as illustrated in FIG. 8. The suspension system 92 includes a plurality of springs 94, a mounting plate 96, a plurality of washers 98, a plurality of threaded screws 100, and a plurality of stops 102. The motor 78 is secured on a motor foot plate 104 via a plurality of upward facing screws 108, which is then mounted on the mounting plate 96. The plurality of washers 98 are preferably rubber, neoprene, or other similar compressible material and are positioned and secured between the mounting plate 96 and the motor foot plate 104 to create a gap 106 between the mounting plate 96 and the foot plate 104 and to provide cushioning therebetween. The washers 98 are secured to the mounting plate 96 via the plurality of screws 100, which extend downward through the foot plate 104. The plurality of stops 102 also extend downward through the foot plate 104 but are considerably longer than the screws 100 so that the plurality of stops 102 can extend through the foot plate 104, the gap 106 created between the mounting plate 96 and the foot-plate 104, the mounting plate 96, and the base plate 24. As described more fully below, the plurality of stops 102 act as a maximum vertical limit on movement of the motor 78 when in operation.

The mounting plate 96 is mounted on the plurality of springs 94, which are secured to the base plate 24 and are preferably compressions springs. As can be appreciated, operation of the motor 78 creates a significant amount of vibration. Because the motor 78 is mounted on the mounting plate 96, which is mounted on the springs 94, vibration of the motor 78 results in the springs 94 contracting and extending. As the springs 94 extend, the joined mounting plate 96 and foot plate 104 and are allowed to rise a vertical height that is limited by the plurality of shift stops 102, such that the shift stops 102 act as the maximum vertical limit for the combined plates 96,104. In limiting the vertical height the plates 96, 104 can travel, the movement of the motor 78 is consequently limited, which prevents or lessens normal wear and tear on the motor 78 and lessens the possibility that supply lines and electrical lines will become loose. Thus, the above-described motor suspension system 92 limits the negative effects of a substantial amount of the vibration cause by operation of the motor 78, including limiting wear and tear on the motor and surrounding structure and noise caused by the vibration.

Figure 2:
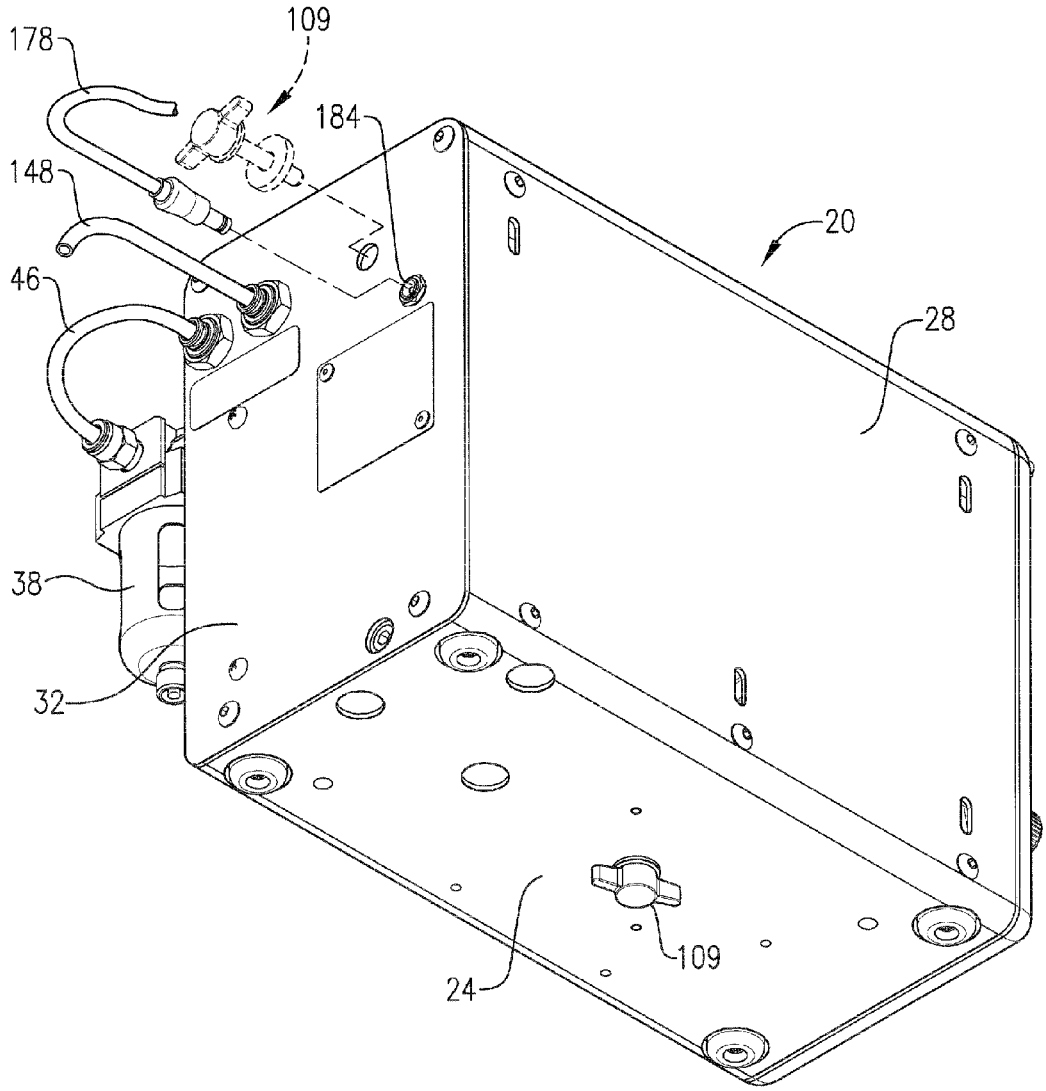
FIG. 2 is a bottom perspective and partial assembly view of the impact power tool illustrated in FIG. 1 with components removed and showing the assembly of one of the external air fittings and one of the lock wing screws (shown in phantom)

During transport of the impact power tool 10, movement of the motor 78 is not desired, even if limited by the motor suspension system 92 and shift stops 102. Therefore, a locking wing screw and washer combination 109, hereinafter referred to as a shift lock, is provided that can be secured prior to transport and that lock the motor 78 and mounting plate 96 securely to the base plate 24, preventing movement during transport. The shift lock, as illustrated in FIGS. 2, and 14, can be tightened and loosened by a user via an underside of the base plate 24 to restrict/allow movement of the motor 78. In particular, the wing screw of the shift lock 109 is received into a tapped hole in mounting plate 96 so as to draw the motor suspension system 92 firmly down to the base plate 24 during transport. When the shift lock 109 is removed after transport and the impact power tool 10 is unpacked and readied for use, the shift lock 109 is removed from the base plate 24 and stored in a provided location in the back panel 32 of housing 20, as shown in phantom in FIG. 2.

As illustrated in FIG. 8, a rotatable output shaft 110 extends from the motor 78 and is sized to be inserted in the central rotor 80. The central rotor 80 comprises a hollowed body 112 and a rotor port 114, wherein the rotor port 114 includes an elongated slot 116, which will be described in more detail below. Once the central rotor 80 is positioned on the output shaft 110, the output shaft 110 preferably does not extend to even at least partially block the elongated slot 116, such that when in operation, the elongated slot 116 is not blocked at all by the output shaft 110. The central rotor 80 extends through a flywheel 118, a spacer 120, and the rotary valve 82. As illustrated in FIG. 7, the flywheel 118 sits atop an upper end of the motor 78, and the rotary valve 82 sits atop the flywheel 118, such that the central rotor 80 extends through the rotary valve 82, as described below.

The rotary valve 82 comprises a valve body 122 and a valve bushing 124. As illustrated in FIG. 8, the valve body 122 is a reverse hourglass shape, such that lower and upper portions 126,128 of the valve body 122 have a smaller circumference than a middle portion 130 of the body 122. The middle portion 130 includes a plurality of threaded apertures 132 for receipt of fittings 134 for supply lines. The reverse hourglass shape allows sufficient space in the middle portion 130 for receipt of the fittings 134 without the added weight that would arise if all portions of the body 122 were of the same circumference. Because the rotary valve 82 sits atop the motor 78, added weight inhibits the motor operation. The less weight of the rotary valve 82 due to the reverse hourglass shape decreases the amount of weight on the motor 78. Other valve body shapes could be employed, such as, for example, the upper portion 128 having the increased circumference, as long as the body 122 is wide enough to receive the fittings 134.

It is expressly noted that although a mechanical rotary valve is described herein, the present invention contemplates use of an electrical or electromechanical valve, such as an electronically fired solenoid valve, that would include the same or similar pulsing features described below. However, use of an electromechanical valve would not require use of the motor 78. Additionally, the pulse cycles described below in the discussion of the rotary valve 82 would still occur, except that the drive assembly would be a linear drive assembly. Thus, the electromechanical valve would still be operable to produce alternating intake and exhaust cycles.

The valve body 122 is hollowed, and the valve bushing 124 is fixedly secured within. The valve bushing 124 is also preferably hollowed and is further preferably made of a carbon/graphite composite material. As best illustrated in FIG. 7, the bushing 124 includes an exhaust port 136, an intake port 138, and an output port 140. The exhaust port 136 further includes an elongated slot 142 of similar size and configuration as the elongated slot 116 of the central rotor 80. Although it is preferred that the elongated slot 116 of the central rotor 80 is approximately equal in size and configuration as the elongated slot 142 of the bushing 124, variations in size and configuration are expected due to manufacturing tolerances, and therefore, exact matching is neither required nor expected. The intake port 138 is of a larger cross section area and utilizes more degrees of valve 82 rotation than the exhaust port 136. The intake port 138 is generally a square or rectangular shape, although other suitable shapes may be employed, such as circular, as long as the area of the intake port 138 is larger than a cross sectional area of the elongated slots 116, 142.

Figure 9:
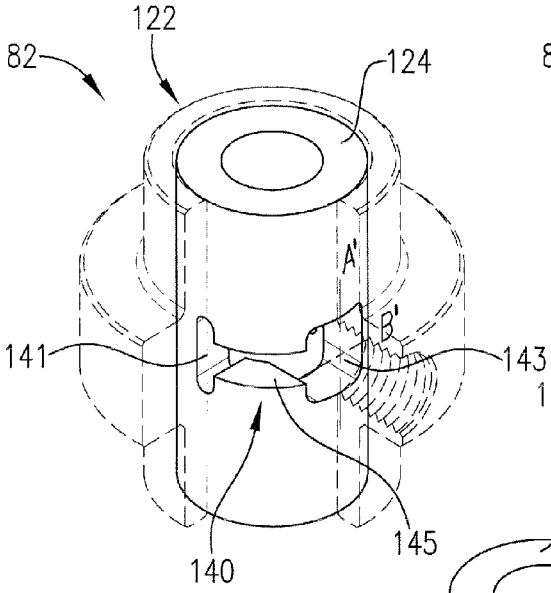
FIG. 9 is an enlarged partial front perspective view of the impact power tool illustrated in FIGS. 1-8 showing the rotary valve with the rotor removed and the housing shown in phantom to illustrate the output port of the valve bushing.

The output port 140 is composed of a generally circumferentially oriented slot through the wall of bushing 124, such that the output port 140 utilizes approximately 90° of a circumference of the bushing 124. The output port 140 is constructed by left and right aperture segments 141,143 joined into one continuous circumferentially oriented slot by a horizontal aperture 145. Each aperture segment 141,143 of the output port 140 is shaped to approximate the same shape as the diametrically opposed port. Thus, in FIG. 9, the left aperture segment 141 of the output port 140 is shaped to approximate the diametrically opposite exhaust port 136, and similarly, the right aperture segment 143 of the output port 140 illustrated in FIG. 9 is shaped to approximate the diametrically opposite intake port 138. The horizontal aperture 145 joins both left and right apertures 141,143 for communicative air flow. Although the horizontal aperture 145 is shown visibly narrower than the left and right apertures 141,143, it could be wider or even the same height as the left and right apertures 141,143, which would yield an output port 140 with no narrower or wider portions and thus appear as a horizontally elongated slot. However, use of the relatively narrow horizontal aperture 145 maximizes the bearing area of the bushing 124 for longer wear and lower rotational force.

Operation of the rotary valve 82 will be described in more detail below.

To mount the rotary valve 82 on the motor 78, the valve body 122 with the hollowed bushing 124 fixedly secured therein is slid over the central rotor 80, such that the elongated slot 116 of the central rotor 80 is aligned with the matching elongated slot 142 of the bushing 124. Alignment of the elongated slots 116,142 occurs when pressurized air can pass through both slots 116,142. A washer and screw combination 144 (see FIG. 8) is threadably secured with the central rotor 80, which mounts the rotary valve 82 to the motor 78.

As noted above, the valve body 122 includes threaded apertures 132 for receipt of fittings 134 to connect supply lines. As best illustrated in FIGS. 6 and 9-13, the apertures 132 are aligned with the exhaust, intake, and output ports 136,138,140 of the valve bushing 124. Reference numerals for the various ports in FIG. 6 refer to the ports of the bushing 124. As discussed above, air from the tank supply line 76 enters the rotary valve 82 via the intake port 138. Air can then exit the rotary valve 82 either through the exhaust port 136 or the output port 140. Air exiting the output port 140 is guided through a valve output supply line 146 and to the hand held device 18, as illustrated in FIG. 7. Similarly, air exiting the exhaust port 136 is guided through either a throttle supply line 148 to the throttle 84 or through a fine adjust supply line 150 and to the throttle bias valve 86, as illustrated in FIG. 6 and as described in more detail below.

The hand held device 18 is any pressurized air impact work tool 152 for carving, engraving, or other delicate operation that includes a chisel or hammer tool 154 for impacting an article. Fluid actuated hand held devices are also known in the art and contemplated by the present invention. The work tool 152 of the hand held device 18 preferably includes an internal, hollowed chamber (not shown) and a spring-loaded, air actuated piston (not shown) housed therein and operable to move forward and backward along a stroke length upon injection of pressurized air into the chamber, as is well known in the art. Pressurized air transported through the valve output supply line 146 exits to the work tool 152 of the hand held device 18 to operate the piston, resulting in impact by the chisel or hammer tool 154 of the work tool 152. The hand held device 18 of the present invention is fully described in the '912 Glaser patent and is hereby incorporated by reference.

The hand held 18 device further includes a work tool selector 156 accessible on the front panel 34 of the housing 20, as illustrated in FIGS. 6 and 7. As can be appreciated, different sized work tools having different sized hammers may be desired depending on the type of carving or engraving being performed. The present invention allows up to two work tools 152 to be connected, via first and second hand held device fittings 158, to the impact tool device 10 at any one time, although only one work tool 152 can be operated at a time. Rotation of a dial 160 of the work tool selector 156 selectively adjusts valve output supply line 146 to be in alignment with the selected work tool 152.

As noted above, air exiting the exhaust port 136 of the rotary valve 82 is guided through either the throttle supply line 148 to the throttle 84 or through the fine adjust supply line 50 to the throttle bias valve 86. The throttle 84 and throttle bias valve 86 operatively cooperate to allow selective bleeding of air to the atmosphere during operation. The throttle 84 includes a foot pedal 162 (see FIG. 1) for operation by a user and operatively coupled with the housing 20 of the impact power tool 10 at the back panel 32 of the housing 20, as best illustrated in FIG. 2. The foot pedal 162 of the present invention is more fully described in the '912 Glaser patent.

The throttle 84 operates to actuate the work tool 152 of the hand held device 18 by depressing the foot pedal 162. When the foot pedal 162 is in its rest state and not depressed, and the throttle bias valve 86 is closed or mainly closed, it is not possible for sufficient exhaust to flow out of either of the throttle supply line 148 or the fine adjust supply line 150 to allow the piston of the work tool 152 to retract. Consequently, as the central rotor 80 rotates to the next pressure intake position, the piston cannot move forward because it did not retract during the exhaust portion of the valve cycle. In contrast, when the foot pedal 162 is depressed and/or the throttle bias valve 86 is open sufficiently, as the rotor 80 is rotated, and the elongated slot 116 comes into alignment with the exhaust and intake ports 136,138, and therefore also the diametrically opposite output port 140, there will be alternating periods of exhaust and intake, respectively, sufficient to actuate the piston of the work tool 152, thus creating controlled impact. The impact cycle, i.e., when the elongated slot 116 is aligned with the exhaust and intake ports 136,138, repeats every 180° rotation of the rotor 80, as long as sufficient exhaust is allowed to exit by either depressing the foot pedal 162 and/or opening the throttle bias valve 86. Further description of the operational features of the rotary valve 82 is described below.

As can be appreciated, in order to begin operation of the work tool 152 using the foot pedal 162 of the throttle 84, the foot pedal 162 must be depressed enough to allow sufficient air to escape from the chamber of work tool 152 so that the following intake air pressure pulse can move the internal piston of work tool 152 to create the desired impact. This depression of the foot pedal 162 the initial amount is herein referred to as "pretravel." As the air is released from the chamber of work tool 152, the spring can move the piston into a retracted rest position. From this retracted rest position, the addition of pressurized intake air will force the piston forward, creating an impact that is transferred to the chisel or hammer tool 154. If the foot pedal 162 is not depressed and/or the throttle bias valve 86 is not open, the loading of the chamber of the work tool 152 with pressurized air will prohibit the piston from stroking back and forth. Because the air regulator 40 using dial 14 allows the user to control the pressure of intake air, it is possible to control the amount of air pressure that loads into the chamber of work tool 152. At elevated air pressure loads, it can be appreciated that the foot pedal 162 must be depressed considerably further to allow sufficient air to exhaust in order that the piston can move into a retracted position. This variable air pressure loading creates inconsistent foot pedal behavior. By opening the throttle bias valve 86, the user can allows a desired amount of exhaust air to escape, such that any movement of the foot pedal 162 will cause immediate piston retraction. Therefore, the addition of the throttle bias valve 86 aids greatly in the control of the work tool 152 and allows the user to make use of a much wider range of air pressures to operate the work tool 152 without the resulting pretravel of foot pedal 162.

As illustrated in FIG. 7, the throttle bias valve 86 allows selective release of pressure into the atmosphere. The throttle bias valve 86 includes a rotatable dial 164 for operation by the user. If the user wishes to avoid the overdrive effect and pretravel caused by the initial storage of pressurized air in the chamber of the work tool 152, the user can bleed off or release some of the pressurized air without using the throttle 84. Thus, when the throttle bias valve 86 is closed, there is no effect on the throttle action, and the throttle 84 acts as described above. When the throttle bias valve 86 is opened, however, pressurized air is allowed to escape to the atmosphere, even if the throttle 84 is not depressed. Use of the throttle bias valve 86 thus allows the user to provide impact power from the hand held device 18 at a constant, selectable impact level without depressing the foot pedal 162 of the throttle 84. Additionally, use of the throttle bias valve 86 allows the user to increase the incoming air pressure to the hand held device 18 to have immediate throttle response. As such, the foot pedal 162 of the throttle 84 would not have to pretravel or be depressed a small degree in order to obtain actuation of the hand held device 18. Moreover, use of the throttle bias valve 86 allows finer control of the throttle 84 by opening the throttle bias valve 86 a relatively small amount such that the hand held device 18 begins to operate with minimal throttle movement, i.e., minimal depression of the foot pedal 162.

In some work situations, the user may desire more impact force from the work tool 152 than is obtained using normal operating air pressure. The user may seek to increase the impact delivered by correspondingly increasing the air pressure. However, any increase in air pressure beyond what is necessary to maintain proper spring compression in work tool 152 can result in compromised operation of work tool 152 and even a reduction in impact power instead of the desired increase. This is largely due to the fact that the increased air from the intake cycle cannot be sufficiently released during the exhaust cycle, which reduces piston stroke travel and hence impact power. However, with the addition of the throttle bias valve 86, it is possible to increase the exhaust of air to allow efficient operation at significantly higher air pressures. This operation at increased air pressures can be referred to as overdrive operation or overdriving.

The pressure gauge 88, as best illustrated in FIGS. 6 and 7, is mounted on the front panel 34 of the housing 20 and is operable to register the pressure outputted via the hand held device 18. Pressurized air outputted from the air storage tank 42 is moved through a gauge supply line 166, as best illustrated in FIG. 6. The gauge supply line 166 is communicatively coupled with the pressure gauge 88 at a gauge intake port 168.

The pressure gauge 88 preferably includes an outward facing register face 170 that includes a needle 172 and markings (not shown) for reflecting the magnitude of pressurized air incoming in pounds per square inch (psi), and preferable, the markings register at least 60 psi. A suitable pressure gauge is manufactured by Ashcroft Inc. of Stratford, Conn.

As illustrated in FIGS. 2 and 6, the electrical assembly 90 comprises a printed circuit board (PCB) 174, a speed selector 176, a plurality of electrical wires (not shown), a power cord 178, and a power switch 180. The PCB 174 is any printed circuit board operable to control operation of the impact power tool 10, including receipt of instructions from the speed selector 176 and the throttle 84. The speed selector 176 comprises a rotatable dial 182 for selecting a preferred strokes per minute of the piston in the work tool 152. The power cord 178 is any cord operable to supply power from a standard electrical power outlet device to the impact power tool 10. A power outlet 184 is illustrated in FIG. 2 for connection of the power cord 178 with the housing 20. The power switch 180 is mounted on the front panel 34 and allows for selective on/off of power to the impact power tool 10. Electrical wires for communication of the various above-described components extend between the speed selector 176 and the PCB 174, the power outlet 184 and the PCB 174, the power switch 180 and the PCB 174, and the motor 78 and the PCB 174. The wires are connected to the base plate 24, making the base plate 24 a non-conductive terminal board.

The impact power tool 10 also includes an auxiliary air supply 188 for use with other pressurized air power tools 190. The auxiliary air supply 188 includes an auxiliary supply line 192 extending from the air storage tank 42 and to an auxiliary air port 194 located on the front panel 34 of the housing 20, as best illustrated in FIG. 1. The impact power tool 10 thus provides a mechanism for filtering and regulating pressurized air for use with extraneous power tools 190, such that the pressure used for said tools can be monitored by the pressure gauge 88. The convenience of the auxiliary air supply 188 is in part allowed by use of the air storage tank 42.

As briefly discussed above, the housing of the impact power tool 10 stores the air delivery system 12 and the drive assembly 16. The housing is vertically oriented, as opposed to horizontally oriented, to conserve space on the user's crowded work bench. The base plate 24 is non-metallic, and in preferred forms, the base plate 24 is a thick plastic. Use of a plastic base plate 24 allows for connecting of the electrical wires on the base plate 24 and other electrical isolation. Additionally, use of the plastic base plate 24 reduces noise and vibration in conjunction with the above-described motor suspension system 92. The base plate 24 further includes a condensation drain path (not shown) for drainage of condensation resulting from the pressurized air.

The multi-panel construction of the cover 26 of the housing 20 allows for simplified removal of any one panel for access to the interior space 22 of the housing 20. Additionally, because any one panel can be easily removed, future expansion modules may be added to the existing housing 20 without constructing a completely new housing. Further, because the panels are flat metal, the housing 20 is free of any bends in sheet metal, further simplifying manufacture and construction.

Figure 4:
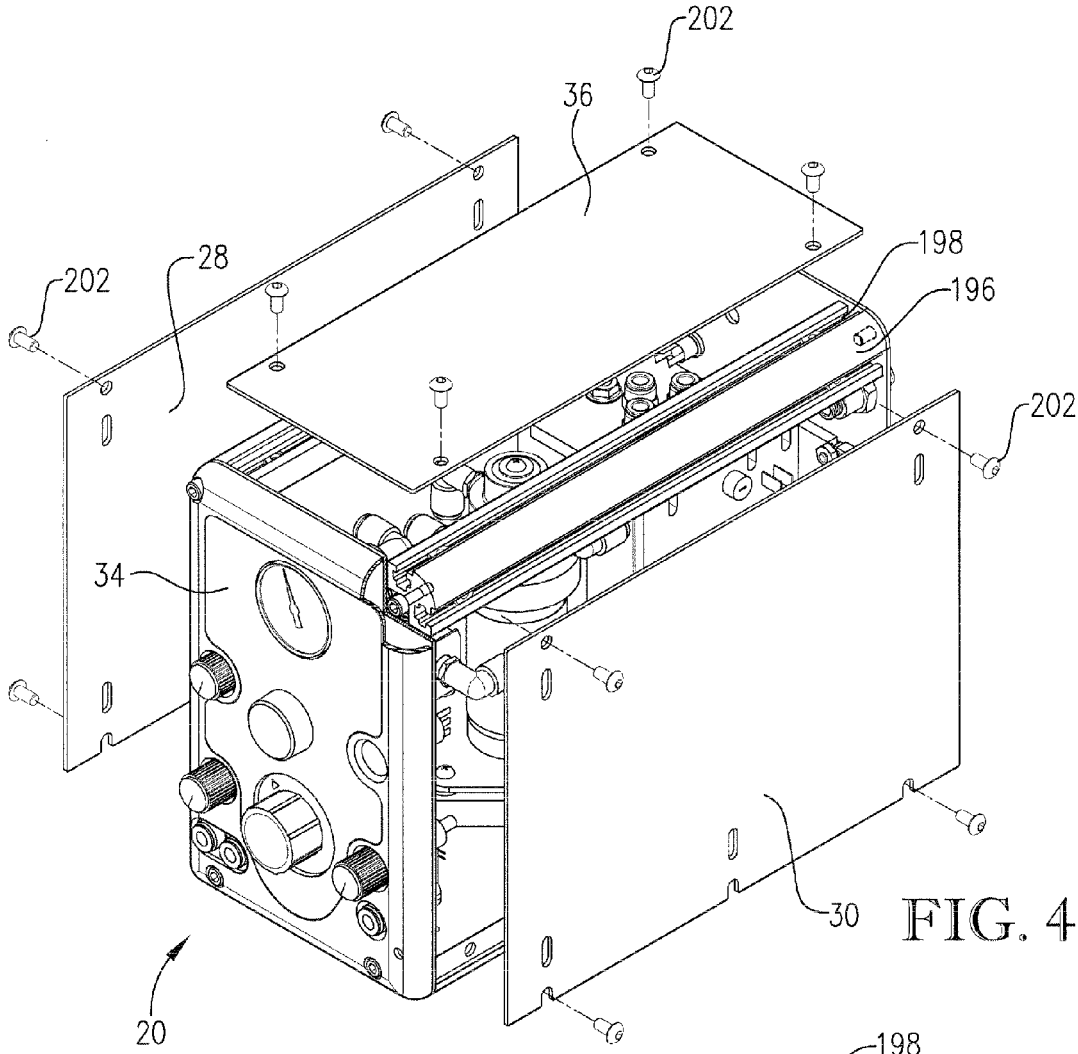
FIG. 4 is a front perspective assembly view of the impact power tool illustrated in FIGS. 1-3 with components removed and showing the assembly of the cover panels of the housing.
Figure 5:
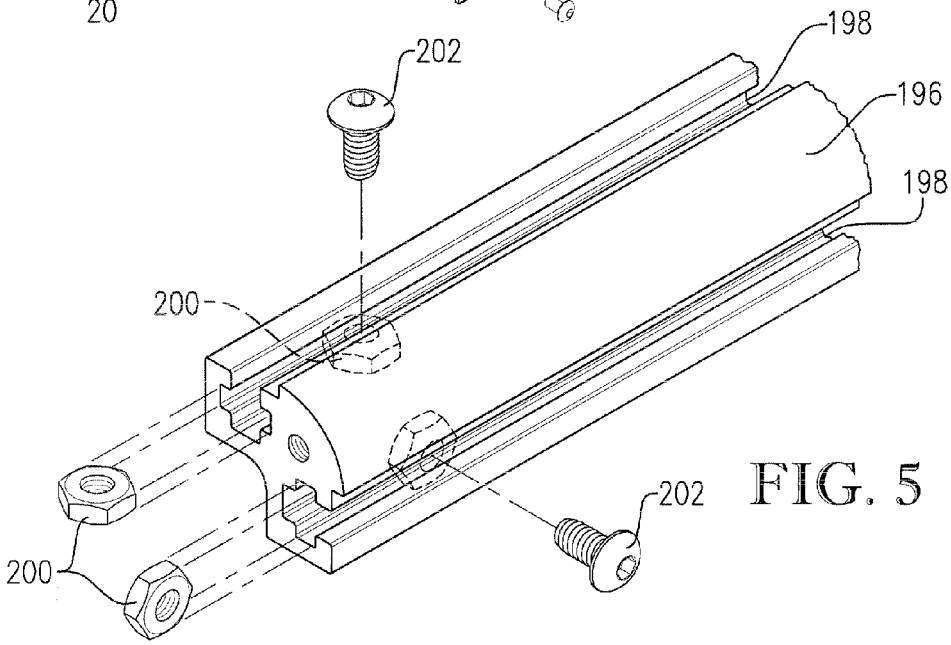
FIG. 5 is an enlarged, fragmentary assembly view of the impact power tool illustrated in FIGS. 1-4 showing how the hex nuts for the cover panels slide (shown in phantom) into the channels in one of the rails.

The housing 20 further includes left and right extruded, beveled rails 196. As best illustrated in FIGS. 4 and 5, each rail 196 includes a channel 198, such that when the respective panel is fitted against the rail 196, hex nuts 200 and hex screws 202 can be used to secure the panel to the rail 196. The hex nuts 200 are guided in the channels 198 and secured via the hex screws 202. Because hex nuts 200 are used, a threaded aperture for a threaded screw does not have to be machined or tapped into the rails 196. This eliminates use of several tapped holes, which simplifies the manufacturing process and allows the user to easily replace any damaged female threads by replacing the hex nuts 200.

In operation, the port geometry described above for the rotor port 114 of the central rotor 80 and the exhaust port 136 of the valve bushing 124 addresses several operational issues, including low speed impact performance, high speed piston response, and throttle control sensitivity. In particular, the elongated slot design of the rotor port 114 and exhaust port 136 allows for quicker opening and closing of air flow and an increase in open cross sectional port area, which results in additional impact performance for the hand held device 18. As described above, when pressurized air enters the rotary valve 82, air will not flow to the hand held device 18 unless the elongated slot 116 of the central rotor 80 is in alignment with the intake port 138 of the valve bushing 124. This alignment occurs every 180° rotation of the central rotor 80. Therefore, every 180° rotation, a "pulse" of pressurized air is received by the hand held device 18, which results in one strike of the hammer or chisel tool 154 of the work tool 152 against an article. When the elongated slot 116 of the central rotor 80 is aligned with the exhaust port 136, air enters the exhaust port 136 and either of the throttle supply line 148 or fine adjust supply line 150, as described above.

Figure 10:
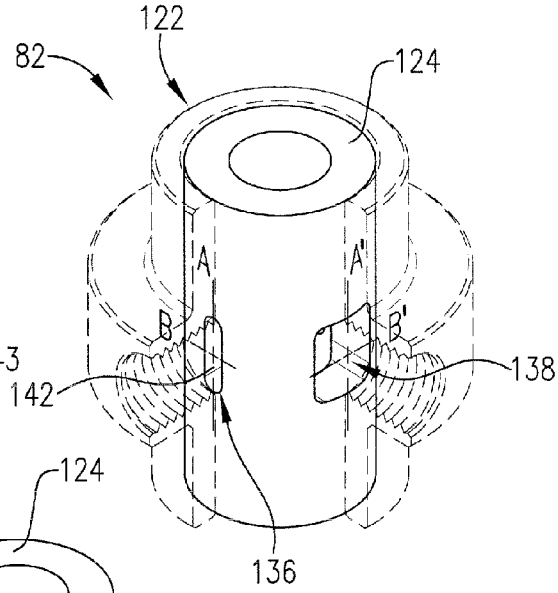
FIG. 10 is an enlarged partial rear perspective view of the impact power tool similar to FIG. 9 showing the rotary valve from the other side to illustrate the intake and exhaust ports of the valve bushing.
Figure 11:
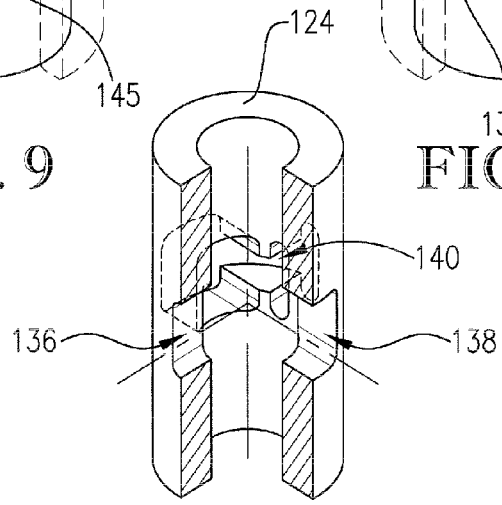
FIG. 11 is an enlarged partial sectional view of the impact power tool illustrated in FIGS. 1-10 showing the valve bushing of the rotary valve.
Figure 12:
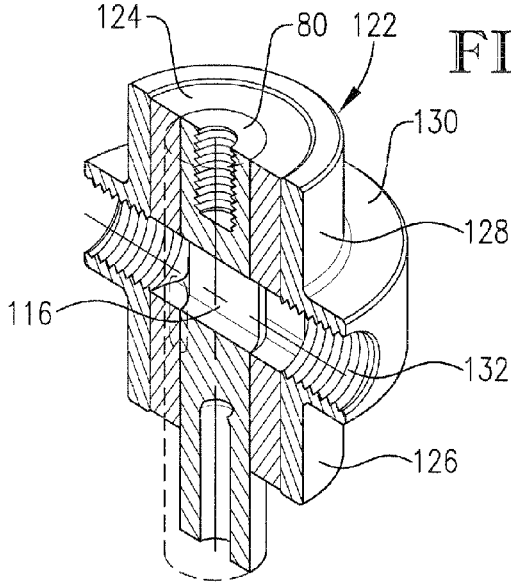
FIG. 12 is an enlarged partial sectional view of the impact power tool illustrated in FIGS. 1-11 taken generally along the longitudinal center of the rotary valve when the rotor port is aligned with the intake and output ports of the valve bushing.
Figure 13:
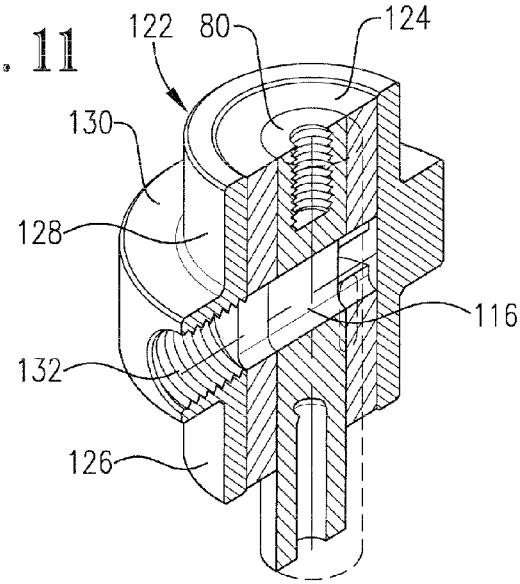
FIG. 13 is an enlarged partial sectional view of the impact power tool similar to FIG. 12 taken generally along the longitudinal center of the rotary valve, but offset ninety degrees from the view of FIG. 12 and when the rotor port is aligned with the exhaust port of the valve bushing.

The elongated port design of the present invention provides a distinct advantage over other prior art designs. In preferable form and as illustrated in FIGS. 8 and 10, the elongated slots 116,142 have a major dimension or height extending along a vertical axis A of the slot, and a minor dimension or width extending along a horizontal axis B of the slot. It is to be noted that because the elongated slots 116,142 of the central rotor 80 and valve bushing 124 were described above as having similar, but not necessarily equivalent, size and configuration, the major and minor dimensions described herein are only illustrated in FIG. 10 for elongated slot 142 but should be understood to apply to both elongated slots 116,142. However, it is contemplated by the present invention that the major dimension of the elongated slot 142 of the exhaust port 136 is preferably approximately 90-150% the major dimension of the elongated slot 116 of the rotor 80; more preferably the major dimension of the elongated slot 142 is approximately 100-140% the major dimension of the elongated slot 116; and most preferably the major dimension of the elongated slot 142 is approximately 110-130% the major dimension of the elongated slot 116, with the preference being approximately 120%. Similarly, the minor dimension of the elongated slot 142 of the exhaust port 136 is preferably approximately 70-130% the minor dimension of the elongated slot 116 of the rotor 80; more preferably the minor dimension of the elongated slot 142 is approximately 80-120% the minor dimension of the elongated slot 116; and most preferably the minor dimension of the elongated slot 142 is approximately equal to the minor dimension of the elongated slot 116. In a preferred form, the ratio of the major dimension to the minor dimension of each of the elongated slots 116,142 is greater than 1:1; in a more preferred form, the ratio of the major dimension to the minor dimension is greater than or equal to 2:1; and in a most preferred form, the ratio of the major dimension to the minor dimension is greater than or equal to 3:1. Preferred shapes of the elongated slots 116,142 include oval, elliptical, rectangular (with the long side of the rectangle along the vertical axis of the slot), and other oblong shapes.

Similarly and as also illustrated in FIGS. 9 and 10, the intake port 138 and the right aperture 143 of the output port 140 are preferably described as having a first dimension or height along a vertical axis A' and a second dimension or width along a horizontal axis B'. In some embodiments, the first and second dimensions may be equivalent. Preferably, the first dimensions or heights of the intake port 138 and the right aperture 143 of the output port 140 are approximately 90-150% the major dimension of the elongated slot 116; more preferably the first dimensions of the intake port 138 and the right aperture 143 of the output port 140 are approximately 100-140% the major dimension of the elongated slot 116; and most preferably the first dimensions of the intake port 138 and the right aperture 143 of the output port 140 are approximately 110-130% the major dimension of the elongated slot 116, with the preference being approximately 120%. Similarly, the second dimensions or widths of the intake port 138 and the right aperture 143 of the output port 140 are preferably at least greater than the minor dimension or widths of elongated slot 116; more preferably, the second dimensions of the intake port 138 and the right aperture 143 of the output port 140 are up to approximately five times greater than the minor dimension of elongated slot 116; and most preferably, the second dimensions of the intake port 138 and the right aperture 143 of the output port 140 are up to approximately four times greater than the minor dimension of elongated slot 116, with the preference being approximately 3.3 times greater.

Having this ratio of major dimension to minor dimension for the elongated slots 116,142 allows for the quicker opening and closing of the air flow. As can be appreciated, as the elongated slot 116 of the central rotor 80 begins to come in alignment with the elongated slot 142 of the valve bushing 124, air begins to enter the right aperture 143 of the output port 140. Because of the elongated major dimensions of the ports, air enters at a faster rate than with, for example, a circular port. For comparison, with a circular port, air enters/exits at a slower rate because the amount of cross sectional area available in the port is less at the beginning and ending stages of alignment. With the elongated slots 116,142 of the present invention, air enters/exits at a much faster rate because of the increased cross section of the slots 116,142, which results is the quicker opening and closing of the air flow.

The elongated port design also allows for more air to enter than a circular port geometry. When a circular port geometry is implemented, the only way to increase air flow is to increase the diameter of the port. However, the diameter of a circular port is restricted to approximately ⅛th or 12.5% of the circumference of the central rotor 80. In contrast, the present invention's rotor port 114 geometry, as shown by slot 116, has a port width less than approximately 8% of the circumference of the rotor shaft. However, because the overall cross sectional areas of the present invention's ports are larger than the circular port geometry, more air is allowed to enter the output port 140. This results in increased impact performance by the hand held device 18.

The elongated port geometry of the present invention also results in a larger variation in cycle time between the pressure pulse described above and the bleed pulse. The graph of FIG. 15 illustrates the degrees of rotation of the central rotor 80 versus the area exposed by alignment of the slots 116,142 of the central rotor 80 and the valve bushing 124. The prior art circular port geometry is represented by a broken line, and the present invention's elongated port geometry is represented by a solid line. As can be seen, for a prior art circular port geometry, as the rotor rotates, the amount of area in alignment slowly opens. This is discernable by viewing the gradual rise (slope) of the prior art design. Similarly, as the rotor continues to rotate past peak alignment, i.e., when the ports are in exact, matching alignment, the amount of area exposed decreases at a slow rate. As further illustrated in the graph, no alignment, and therefore, no exposed area of the port, occurs at exactly 90°.

In marked contrast, the present invention illustrates a much faster increase in aligned area of the slots 116,142 of the central rotor 80 and valve bushing 124, as discernable by the larger positive slope as compared to the prior art. Additionally, the present invention provides a significantly larger amount of aligned area than the prior art, which allows more increased air flow. A further advantage of the present invention is that the bleed time or pulse, represented as the negative area in FIG. 15, occurs in less degrees of rotation than the prior art. Because the minor dimension of the elongated slot 116,142 of the central rotor 80 is less than the diameter of the prior art circular port, the elongated slot 116 is in alignment with the exhaust port 136 for fewer degrees of rotation. Thus, by making the pressure pulse, viewed as the positive area in FIG. 15, longer than the bleed pulse, viewed as the negative area in FIG. 15, low speed impact performance of the hand held device 18 is substantially improved. Additionally, because of the longer pressure pulse, the high speed response of the hand held device 18 is also improved.

The air storage tank 42 of the present invention also facilitates in meeting the demands of the impact power tool 10. In particular, due to the demands of the high speed, pulsed air system of the impact power tool 10, pressurized air from the pressurized air source must be regulated extremely quickly. Even modern, high precision air regulators, or high speed precision air regulators, which normally have more than adequate response time, cannot meet the demands of the impact power tool 10 in increasing or decreasing airflow quickly enough to maintain the desired air pressure within reasonable tolerances. The air storage tank 42, however, provides a source of regulated air that is easily accessible by the rotary valve 82. As a numerical example, the air storage tank 42 of the present invention in a preferred embodiment stores approximately 4 to 50 times the internal air volume of the supply lines, which of course hold a certain amount of air volume when in operation; in a more preferred embodiment stores approximately 8-30 times the internal air volume of the supply lines; and in a most preferred embodiment, stores approximately 10-20 times the internal air volume of the supply lines. Thus, even if the regulator 40 experiences a time lag in adequately regulating the incoming pressurized air, enough regulated air is stored in the air storage tank 42 that both low speed impact and high speed response of the hand held device 18 are improved.

The air storage tank 42 capacity can also be compared to the volume of the elongated slot 116 of the central rotor 80. It has been determined that a preferred storage volume of air for the air storage tank 42 is approximately 200 to 3000 times greater than the volume of elongated slot 116 of the central rotor 80. A more preferred range of storage of volume of air for the air storage tank 42 is approximately 500-2000 times greater than the volume of slot 116 of the central rotor 80, and a most preferred range of storage volume is approximately 800-1200 times greater.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. An impact power tool for use in delicate hand working operations, said impact power tool comprising:

an air delivery system operable to communicate with a pressurized air source;

a hand held device including a work tool and an air actuated piston drivingly coupled to the work tool and in driven communication with the air delivery system; and a drive assembly operable to selectively and variably control the actuation of the piston, said drive assembly including a variable speed motor and a valve drivingly coupled to the motor, said air delivery system further including an air regulator upstream of the valve and operable to selectively and variably control the pressure of air flowing downstream therefrom, said air delivery system further including an air storage tank in communication with and disposed between the air regulator and the valve, said air storage tank including a tank inlet, and a tank outlet, and an internal air chamber in communication with both the tank inlet and tank outlet.

2. The impact power tool as claimed in claim 1, said variable speed motor including an output shaft, said valve including a valve bushing and a rotor rotatably received within the valve bushing and drivingly coupled to the output shaft for rotation therewith, said valve bushing including an intake port and an exhaust port, said rotor including an elongated slot, said variable speed motor being configured to rotate the rotor at least four thousand revolutions per minute.

3. The impact power tool as claimed in claim 2, said internal air chamber being sized and configured to store approximately 200 to 3000 times greater volume of air than a volume of said elongated slot of said rotor.

4. The impact power tool as claimed in claim 1; and a housing including a base plate and a cover wherein the cover is sized and configured to enclose at least the variable speed motor and the air storage tank.

5. The impact power tool as claimed in claim 4, said base plate being formed in major portion of a non-metallic material.

6. The impact power tool as claimed in claim 5, said internal air chamber being defined at least in part by the base plate.

7. The impact power tool as claimed in claim 4, said base plate defining a width dimension and said cover defining a height dimension wherein the height dimension is greater than the width dimension.

8. The impact power tool as claimed in claim 7, said cover comprising at least three separate panels wherein each of the panels is spaced from one another and each of the panels is generally planar in configuration.

9. The impact power tool as claimed in claim 8, said housing further including a plurality of rails wherein each rail is disposed between at least two panels, each of said rails being extruded, each of said rails including a channel operable to slidably receive a hex nut.

10. The impact power tool as claimed in claim 1, said air storage tank including an air manifold having a plurality of fittings sized and configured to receive air hoses, said internal air chamber being defined at least in part by the air manifold.

* * * * *